US005245309A

United States Patent [19]

Kawase et al.

[11] Patent Number: 5,245,309

[45] Date of Patent: Sep. 14, 1993

[54] THERMISTOR ELEMENT

[75] Inventors: Masahiko Kawase; Toshiharu Hirota, both of Nagaokakyo, Japan

[73] Assignee: Murata Manufacturing Co., Ltd., Japan

[21] Appl. No.: 848,740

[22] Filed: Mar. 10, 1992

[30] Foreign Application Priority Data

Mar. 12, 1991 [JP] Japan ..... 3-46400

[51] Int. Cl.[5] ..... H01C 7/10

[52] U.S. Cl. ..... 338/22 R; 338/22 SD

[58] Field of Search ..... 338/22 R, 22 SD; 374/183, 185

[56] References Cited

U.S. PATENT DOCUMENTS 4,786,888 11/1988 Yoneda et al. ..... 338/22 R 4,912,450 3/1990 Yoneda et al. ..... 338/22 R

FOREIGN PATENT DOCUMENTS 62-137804 6/1987 Japan .

4-130702 5/1992 Japan .

*Primary Examiner*—Marvin M. Lateef

*Attorney, Agent, or Firm*—Ostrolenk, Faber, Gerb & Soffen

[57] ABSTRACT

A thermistor element in which in a thermistor body having first and second outer electrodes formed on a pair of its end surfaces, a first inner electrode connected to the first outer electrode and a second inner electrode connected to the second outer electrode are so disposed that their ends are opposed a predetermined distance away from each other.

18 Claims, 8 Drawing Sheets

THERMISTOR ELEMENT

BACKGROUND OF THE INVENTION

1. Field of the Invention

The present invention relates generally to thermistor elements, and more particularly, to a thermistor element which is suitably used as a surface mounted type tip component and is subject to small variations in resistance value and B-value.

2. Description of the Prior Art

One example of NTC (negative temperature coefficient) thermistor elements conventionally used as a surface mounted type tip component is shown in FIG. 2. An NTC thermistor element 1 has a structure in which electrodes 3 and 4 are formed on both end surfaces of a single plate type thermistor body 2. Used as the thermistor body 2 is a ceramic sintered body obtained by cutting to a predetermined size a ceramic wafer obtained by slicing a ceramic sintered body block.

The above described NTC thermistor element 1 has been conventionally fabricated in the following manner. More specifically, ceramic powder for forming the thermistor body 2 is first calcined, to obtain a calcined raw material. A binder is then mixed with the calcined raw material, and a mixed raw material obtained is granulated. The granulated raw material is formed to a predetermined size, to obtain a formed body. The formed body is sintered and is sliced in the direction of thickness, to obtain a ceramic wafer having a thickness corresponding to the thickness of the element. The ceramic wafer is annealed at temperatures of 900 to 1100° C. and then, is cut to a predetermined size by a dicing saw and is barrel polished and then, outer electrodes 3 and 4 are formed on both end surfaces thereof. The outer electrodes 3 and 4 are formed by applying conductive pastes such as Ag pastes and baking the same at a predetermined temperature for approximately ten minutes.

The conventional tip type NTC thermistor element obtained in the above described manner has not been widely applied at the present time. The reason for this is that the variation in resistance value of the NTC thermistor element 1 obtained is large, i.e., tens of percent, and the variation in B-value is also very large, i.e., approximately 1.0 to 2.0 percent. Consequently, it is desired that the variation in resistance value and the variation in B-value are reduced.

TABLE 1

| | RESISTANCE | | B-VALUE | |
|---|---|---|---|---|
| CHIP SIZE | R25° C. (k Ω) | R3CV (%) | $B_{25/50}$ (k) | B3CV (%) |
| 3.2 × 1.6 × 1.0 | 15.125 | 13.2 | 3502 | 1.8 |
| 2.0 × 1.25 × 1.0 | 11.536 | 15.2 | 3489 | 1.0 |

On the other hand, in the NTC thermistor element 1 shown in FIG. 2, the resistance value thereof is adjusted by changing the thickness of the ceramic body 2. More specifically, when the resistance value of the NTC thermistor element 1 deviates from a desired resistance value, the resistance value is adjusted by decreasing the thickness of the thermistor body 2 and specifically, the thickness of the above described ceramic wafer by polishing or changing the thickness to which the ceramic sintered body block is sliced to change the thickness of the ceramic wafer. Therefore, the variation in thickness is significantly large between manufacturing lots, so that NTC thermistor elements are forced to greatly vary in thickness although they have the same resistance value. As a result, the NTC thermistor element having a small thickness has the disadvantage of being, for example, chipped or cracked in the actual use.

Furthermore, NTC thermistor elements having a series of resistance values are respectively constructed using different types of materials. Consequently, if an attempt is made to make the thicknesses of the NTC thermistor elements having a series of resistance values constant, one type of material provides only one type of NTC thermistor element having a definite resistance value, so that a large number of types of materials are required. In order to avoid this, a series of types of NTC thermistor elements each having a definite resistance value are made from one type of material by changing the thicknesses of the elements. Therefore, the NTC thermistor elements having a series of resistance values greatly vary in thickness from 0.5 to 1.3 mm Additionally, the conventional NTC thermistor element 1 has the disadvantage of easily varying in characteristics with time and having insufficient life characteristics because the outer electrodes 3 and 4 are exposed to the surfaces.

Moreover, the variation in resistance value of the conventional NTC thermistor element 1 is significantly affected in construction by the variation in size of the thermistor body 2 and the variation in size between the outer electrodes. Accordingly, significantly high precision is required for the NTC thermistor element to take a desired resistance value. On the other hand, a PTC (positive temperature coefficient) thermistor element has the same disadvantages as those of the NTC thermistor element.

SUMMARY OF THE INVENTION

An object of the present invention is to provide a thermistor element which is subject to small variations in resistance value and B-value, does not easily vary in thickness, and is superior in life characteristics.

A thermistor element according to the present invention comprises first and second outer electrodes formed on opposed outer surfaces of a thermistor body and first and second inner electrodes respectively connected to the first and second outer electrodes. The first and second inner electrodes extend into the thermistor body and are formed in the thermistor body. In addition, the first and second inner electrodes are so disposed that their respective ends are opposed a predetermined distance away from each other.

Remaining edges, other than edges respectively connected to the first and second outer electrodes, of the first and second inner electrodes are preferably disposed in the thermistor body, so that the periphery of the inner electrodes is covered tight, thereby to enhance environment resistance and therefore, life characteristics.

Furthermore, the above described thermistor body is more preferably constructed using a monolithic type sintered body obtained by laminating a plurality of ceramic green sheets, along with first and second inner electrode materials, followed by cofiring.

In the present invention, the first and second inner electrodes extend into the thermistor body, so that the resistance value of the thermistor element can be adjusted by adjusting the distance between the opposed ends of the first and second inner electrodes. Consequently, the resistance value of the thermistor element can be adjusted without changing the thickness of the element.

Furthermore, the resistance value of the thermistor element is adjusted by changing the distance between the first and second inner electrodes, thereby making it possible to adjust the resistance value with high precision.

Additionally, in a structure in which edges, other than edges respectively connected to the outer electrodes, of the first and second inner electrodes are disposed in the thermistor body, the inner electrodes are covered tight, thereby to enhance environment resistance and therefore, life characteristics.

Moreover, when a sintered body obtained by laminating a plurality of ceramic green sheets, along with first and second inner electrode materials, followed by cofiring is used as a thermistor body, the variations in diameter of ceramic particles and distribution of pores can be reduced, and the area of the pores in the sintered body can be reduced. More specifically, when thin ceramic green sheets are laminated and a laminated body obtained is sintered to obtain a sintered body having a thickness corresponding to the thickness of the element, the variations in diameter of the ceramic particles and distribution of the pores can be made smaller and the sintered body obtained becomes denser, as compared with a case where a thick sintered body block is sliced to obtain a ceramic wafer. Furthermore, in the present invention, the resistance value is designed and controlled by adjusting the distance between the inner electrodes, thereby to make it possible to decrease the effect of the variation in size of the thermistor body and the variation in size between the outer electrodes on the resistance value. Consequently, it is possible to reduce the variation in resistance value and the variation in B-value of the thermistor element obtained.

According to the present invention, the first and second inner electrodes are so disposed that the respective ends are opposed a predetermined distance away from each other. Accordingly, the resistance of the thermistor element can be adjusted by changing the distance between the first and second inner electrodes. Consequently, the resistance value of the thermistor element can be varied without changing the thickness of the element. Therefore, thermistor elements which differ in resistance value can be obtained although they have the same shape, thereby to make it possible to provide a thermistor element most suitable for a tip component.

The resistance value of the thermistor element has been conventionally adjusted by changing the thickness of the element. Consequently, the thermistor elements have conventionally ranged in thickness from 0.5 to 1.25 mm. Therefore, the thermistor element having a small thickness is liable to be cracked when it is mounted on a substrate, for example. In addition, the thermistor element may not, in some cases, reach constant strength in the bending test. On the other hand, in the thermistor element according to the present invention, the thickness thereof can be made constant as described above, so that the transverse strength thereof can be kept constant, thereby to make it possible to prevent accidents such as the above described cracking in the case of mounting.

Furthermore, the resistance value can be determined by adjusting the distance between the first and second inner electrodes, thereby to make it easy to design the resistance value and make it possible to easily fabricate a thermistor element having a desired resistance value.

Additionally, the inner electrodes can be formed with high precision by printing conductive pastes, and the resistance value is determined by the printing precision of the inner electrodes, thereby to make it possible to obtain a thermistor element having a desired resistance value with high precision.

Furthermore, thermistor elements which differ in resistance value can be obtained by changing the distance between the inner electrodes, thereby to make it possible to design the thermistor elements which differ in resistance value even by using a small number of types of materials, and make it also possible to cut material cost.

Additionally, if the edge portion, which is not connected to the outer electrode, of the first and second inner electrodes is disposed in the thermistor body, it is possible to provide a thermistor element having high environment resistance and therefore, having superior life characteristics.

Moreover, if the thermistor body provided with the first and second inner electrodes is constructed by laminating ceramic green sheets and cofiring the ceramic green sheets, along with first and second inner electrode materials, the variations in diameter of ceramic particles and distribution of pores are smaller and the thermistor body obtained becomes denser, as compared with the conventional method of slicing a sintered body block to obtain a ceramic wafer. Consequently, it is possible to obtain a thermistor element which is subjected to small variations in resistance value and B-value.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
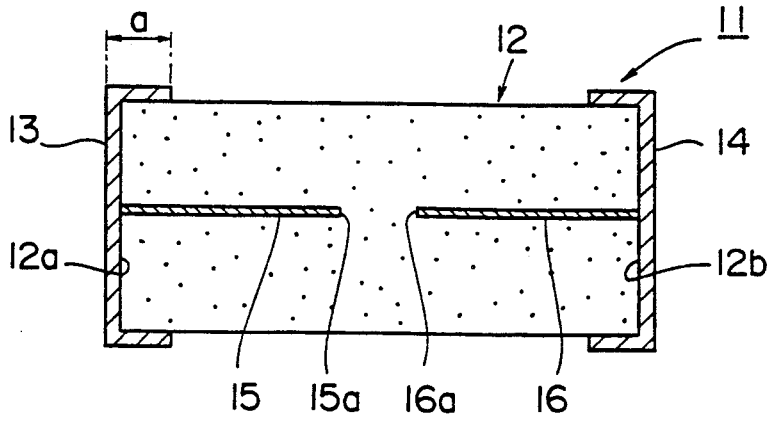
FIG. 1 is a cross sectional view showing a thermistor element according to one embodiment of the present invention.
Figure 3:
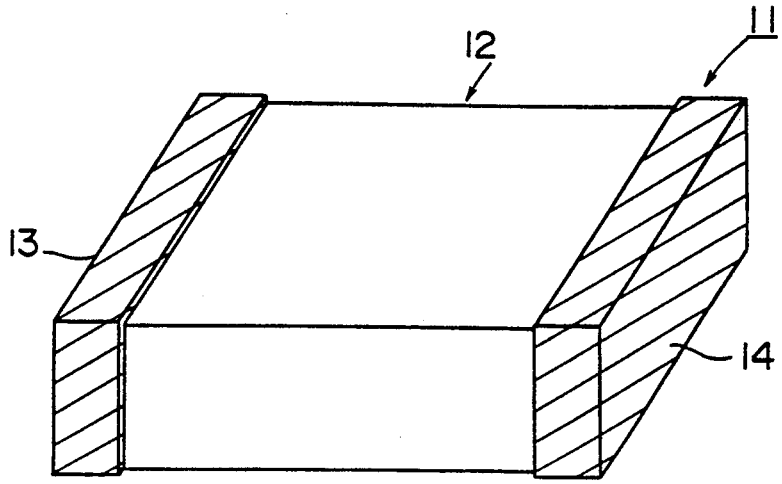
FIG. 3 is a perspective view showing a thermistor element according to the present embodiment.
Figure 4:
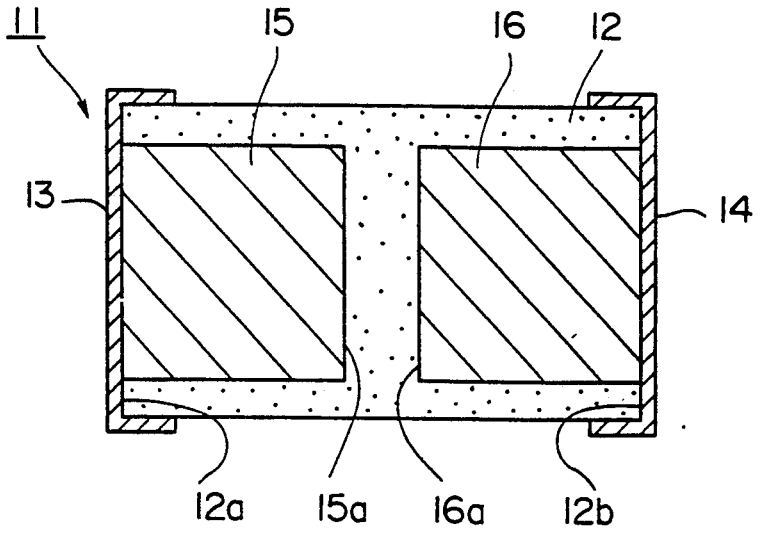
FIG. 4 is a plan sectional view showing the thermistor element according to the present embodiment.

Referring to FIGS. 1, 3 and 4, description is made of a thermistor element according to one embodiment of the present invention. In the present embodiment, an NTC thermistor element will be described.

An NTC thermistor element 11 has a structure in which first and second outer electrodes 13 and 14 are formed on both end surfaces 12*a* and 12*b* of a thermistor body 12. A first inner electrode 15 and a second inner electrode 16 are formed so as to be in a position at the same height, that is, be positioned in the same plane in the thermistor body 12. The first inner electrode 15 is connected to the first outer electrode 13, while the second inner electrode 16 is connected to the second outer electrode 14. In addition, the first and second inner electrodes 15 and 16 are so disposed that their ends 15*a* and 16*a* are opposed a constant distance away from each other.

Since the first and second inner electrodes 15 and 16 are provided as described above, the resistance value of the NTC thermistor element 11 can be varied by changing the distance between the ends 15*a* and 16*a* of the first and second inner electrodes 15 and 16. More specifically, the resistance value of the NTC thermistor element 11 can be adjusted by changing the distance between the ends 15*a* and 16*a* of the first and second inner electrodes 15 and 16, so that the resistance value of the NTC thermistor element 11 can be adjusted without changing the thickness of the element. In the present embodiment, therefore, the resistance value of the NTC thermistor element 11 can be designed with the element having sufficient strength, thereby to make it possible to prevent such accidents that the thermistor body 12 is cracked or chipped at the time of barrel polishing and mounting.

Furthermore, the resistance value of the NTC thermistor element 11 can be varied by changing the distance between the ends 15*a* and 16*a* of the first and second inner electrodes 15 and 16, thereby to make it possible to increase the thickness of the element with the resistance value thereof being constant, while making it possible to design a series of resistance values of the element with the thickness thereof being constant, as compared with the conventional example.

Meanwhile, the thermistor body 12 provided with the first and second inner electrodes 15 and 16 is preferably obtained by laminating a plurality of ceramic green sheets, along with first and second inner electrode materials, followed by cofiring, as in the specific examples of experiments as described later. In this case, by using a sintered body obtained by laminating a plurality of ceramic green sheets, followed by cofiring, the variations in diameter of ceramic particles and distribution of pores are smaller and the thermistor element 12 obtained becomes denser, as compared with the conventional method of slicing a sintered body block to obtain a ceramic wafer. Consequently, it is possible to reduce the variations in resistance value and B-value.

In obtaining the thermistor body 12, however, the plurality of ceramic green sheets need not be laminated, along with the first and second inner electrode materials. For example, the thermistor body 12 may be constructed by affixing two ceramic sintered bodies through the first and second inner electrodes 15 and 16.

Additionally, in the above described embodiment, edges, other than edges respectively connected to the outer electrodes 13 and 14, of the first and second inner electrodes 15 and 16 are disposed in the thermistor body 12, as obvious from FIG. 4. Consequently, the first and second inner electrodes 15 and 16 are not exposed to the exterior, thereby to enhance environment resistance and therefore, life characteristics. When the environment resistance is not particularly required, however, the edges, other than the edges connected to the outer electrodes, of the first and second inner electrodes 15 and 16 may be exposed to the exterior of the thermistor body 12.

Description is now made of the specific examples of experiments.

Prepared as a raw material is one obtained by mixing $Mn_3O_4$, NiO and $Co_3O_4$ at a weight ratio of 45:25:30. The raw material is calcined at a temperature of 1000° C. for two hours and then, the raw material calcined is ground by a pulverizer.

10 to 20% by weight of polyvinyl alcohol serving as an organic binder, 0.5% by weight of glycerine serving as a plasticizer, and 1.0% by weight of a polyvinyl type dispersant are added to the calcined raw material ground and are mixed for 16 hours. A mixed material obtained is changed into a slurry for forming a sheet by passing through a 250-mesh to remove coarse grains. The slurry obtained is formed by the Doctor blade process, to fabricate a ceramic green sheet having a thickness of 50 μm. This ceramic green sheet is cut to a predetermined size, and conductive pastes for forming the inner electrodes 15 and 16 shown in FIG. 4 are printed on the surface of one ceramic green sheet obtained by the cutting. A plurality of ceramic green sheets are laminated above and below the ceramic green sheet having the conductive pastes printed thereon, to obtain a laminated body having the entire thickness of 1550 μm. The laminated body obtained is then pressed in the direction of thickness and is cut into a lot of laminated chips in a rectangular plane shape measuring 2.4 mm×1.5 mm. The laminated chips obtained are sintered at a temperature of 1200° C. for two hours and then, are barrel polished, to obtain a thermistor body 12 shown in FIG. 1 measuring 2.0×1.25×1.0 mm.

Ag pastes are applied to both end surfaces of the thermistor body 12 obtained and are baked at a temperature of 850° C. for ten minutes, thereby to form first and second outer electrodes 13 and 14 to obtain an NTC thermistor element 11.

Meanwhile, as the above described NTC thermistor element 11, five types of NTC thermistor elements are fabricated by printing conductive pastes made of a material having a specific resistance $\rho_{25}=500$ Ωcm such that the distance between the ends 15*a* and 16*a* of the first and second inner electrodes 15 and 16 becomes 0.3 mm, 0.4 mm, 0.5 mm, 1.0 mm and 1.4 mm after sintering.

Measurements are made on the resistance values and the B-values at a temperature of 25° C. of the five types of NTC thermistor elements measuring 2.0×1.25×1.0 mm obtained in the above described manner. The results, along with the variations in resistance value and B-value, are shown in Table 2. In addition, the results of Table 2 are shown in a graph of FIG. 5.

TABLE 2

| DISTANCE BETWEEN INNER ELECTRODES | RESISTANCE R25° C. (k Ω) | RESISTANCE R3CV (%) | B-VALUE $B_{25/50}$ (k) | B-VALUE B3CV (%) |
|---|---|---|---|---|
| 0.3 | 2.762 | 4.8 | 3450 | 0.21 |
| 0.4 | 3.179 | 5.2 | 3452 | 0.19 |
| 0.5 | 3.564 | 5.0 | 3446 | 0.20 |
| 1.0 | 5.337 | 6.1 | 3449 | 0.18 |
| 1.4 | 6.752 | 5.3 | 3457 | 0.19 |

Figure 5:
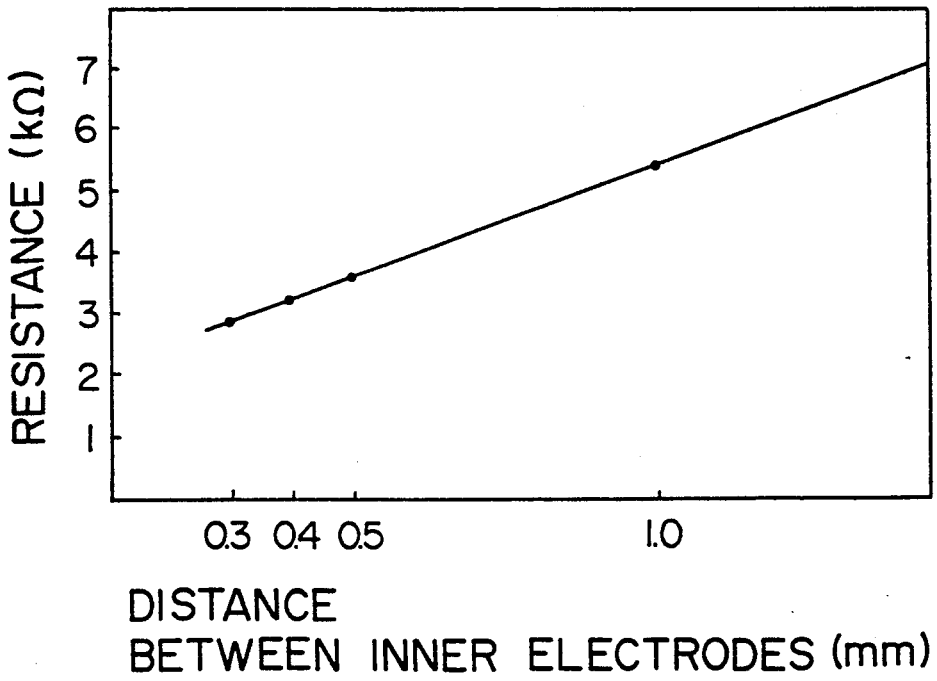
FIG. 5 is a diagram showing the relationship between the distance between first and second inner electrodes and the resistance value.

As can be seen from the results of Table 2 and FIG. 5, the larger the distance between the ends 15*a* and 16*a* of the first and second inner electrodes 15 and 16 is, the larger the resistance value is. However, the B-value is not greatly varied, and the variations in resistance value and B-value are small and stable. Consequently, it is found that NTC thermistor elements which differ in resistance value are obtained without changing the outside diameter by changing the distance between the inner electrodes 15 and 16.

Figure 6:
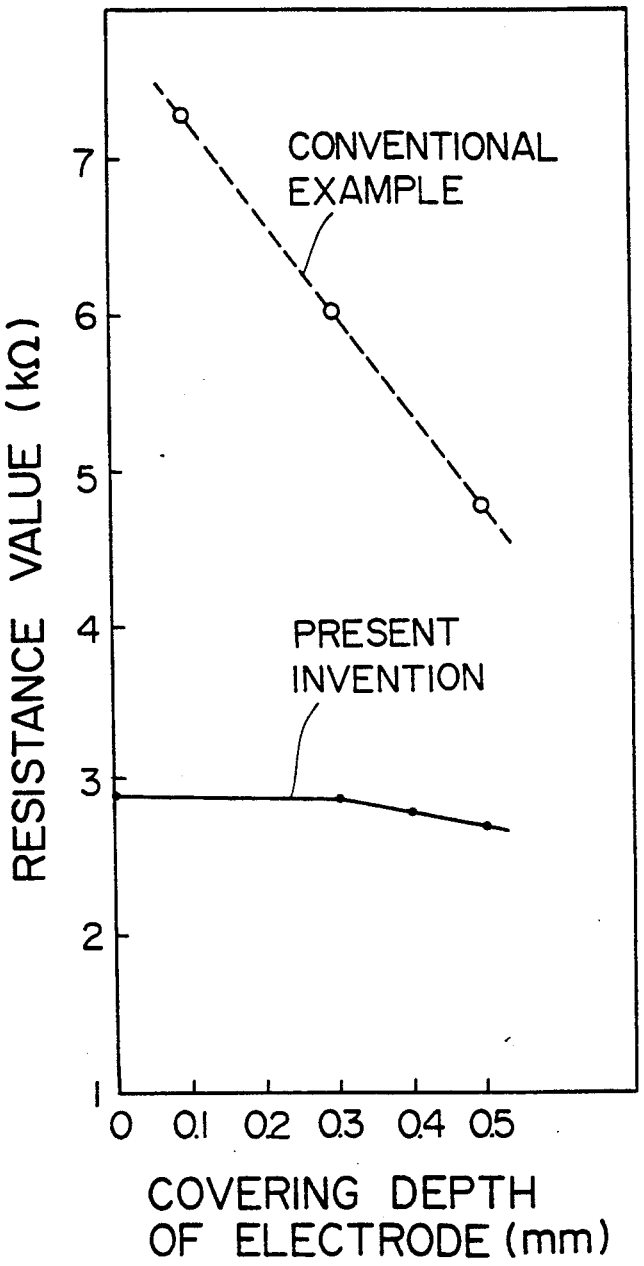
FIG. 6 is a diagram showing the change in resistance value in a case where the covering depth of outer electrodes is changed.

Various NTC thermistor elements are then fabricated by setting the distance between the ends 15*a* and 16*a* of the first and second inner electrodes 15 and 16 to 0.3 mm and changing the covering depth of the outer electrodes 13 and 14 with the side surfaces of the thermistor body 12 (a distance a shown in FIG. 1), and the resistance values of the NTC thermistor elements are measured. The results are shown in FIG. 6 and Table 3. For comparison, the conventional NTC thermistor element 1 measuring 2.0×1.25×1.0 mm in Table 1 is prepared, and the change in resistance value thereof is examined by changing the covering depth of the outer electrodes. The results are also shown in FIG. 6.

TABLE 3

| COVERING DEPTH OF ELECTRODE | RESISTANCE R25° C. (k Ω) | RESISTANCE B3CV (%) |
|---|---|---|
| 0 | 2.788 | 5.2 |
| 0.3 | 2.762 | 6.0 |
| 0.4 | 2.730 | 5.9 |
| 0.5 | 2.680 | 5.4 |

As can be seen from FIG. 6 and Table 3, in the NTC thermistor element according to the present embodiment, even if the covering depth a of the outer electrodes is changed, the resistance value thereof hardly varies. On the other hand, in the conventional NTC thermistor element, if the covering depth a of the outer electrodes is changed, the resistance value thereof greatly varies. Consequently, according to the present embodiment, it is possible to obtain an NTC thermistor element having a desired resistance value without considering the covering depth a of the outer electrodes which is a factor of the variation in resistance value.

Figure 2:
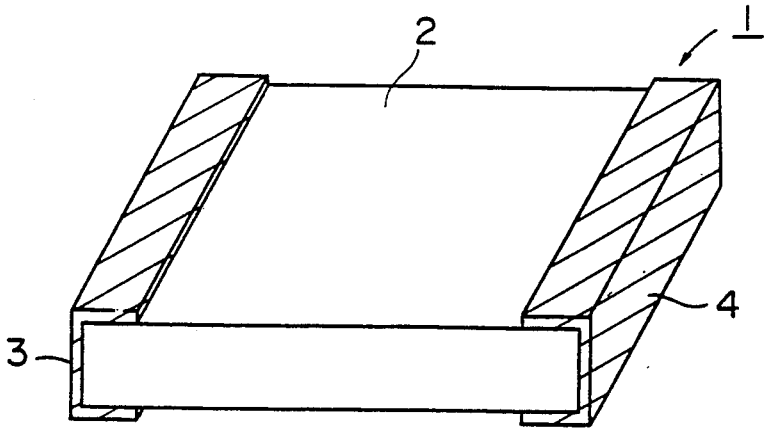
FIG. 2 PRIOR ART
FIG. 2 is a perspective view showing a conventional thermistor element.

The life test is then carried out with respect to the NTC thermistor element according to the above described embodiment. As the life test, the high temperature leaving test in which the NTC thermistor element is left at a temperature of 120° C. and the humidity leaving test in which the NTC thermistor element is left for a long time in an environment of 80° C. and 65 percent relative humidity are adopted, and the rate of change in resistance value of the NTC thermistor element is measured, to evaluate life characteristics. In addition, life characteristics are similarly evaluated with respect to the conventional NTC thermistor element shown in FIG. 2. The results are shown in FIG. 7.

Figure 7:
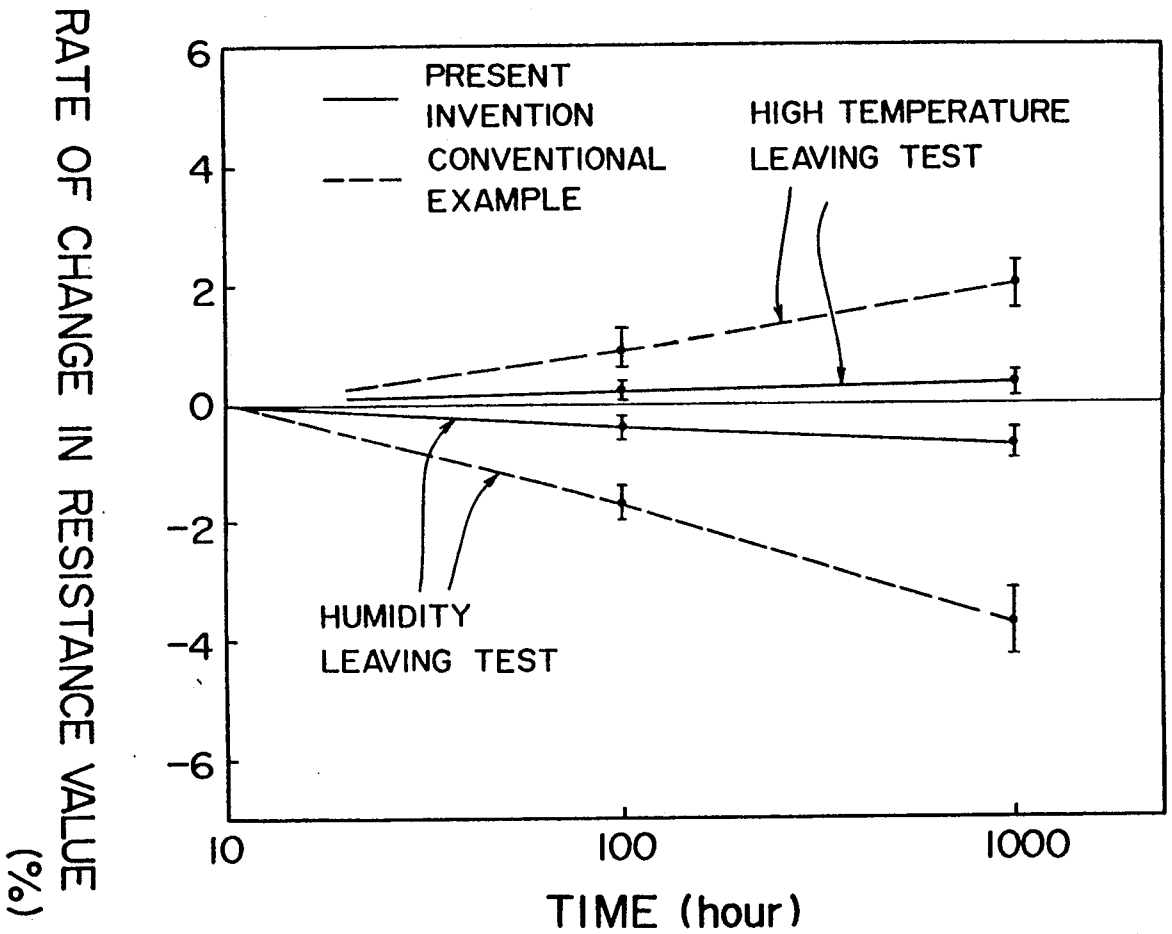
FIG. 7 is a diagram showing the results of the high temperature leaving test and the humidity leaving test.

As can be seen from FIG. 7, in the NTC thermistor element according to the present embodiment, the rate of change in resistance value is very low, and the variation in resistance value is small and stable even if 1000 hours have elapsed in any one of the high temperature leaving test and the humidity leaving test. On the other hand, in the conventional NTC thermistor element, the rate of change in resistance value is significantly raised with the elapse of time, and the variation in resistance value is large.

NTC thermistor elements of the same size as the above described size are then fabricated by altering the conductive material composing the first and second inner electrodes 15 and 16 as shown in Table 4 and setting the distance between the first and second inner electrodes to 0.3 mm. The resistance values and the B-values at a temperature of 25° C. and the variations in resistance value and B-value of the respective NTC thermistor elements obtained are also shown in Table 4.

TABLE 4

| TYPE OF INNER ELECTRODE | RESISTANCE R25° C. (k Ω) | RESISTANCE R3CV (%) | B-VALUE $B_{25/50}$ (k) | B-VALUE B3CV (%) |
|---|---|---|---|---|
| Ag—Pd (7:3) | 3.021 | 5.3 | 3449 | 0.20 |
| Pt—Au | 2.793 | 6.6 | 3443 | 0.18 |
| Pd | 2.961 | 5.8 | 3450 | 0.12 |
| Pt—Au—Pd | 2.833 | 4.9 | 3447 | 0.17 |

As can be seen from Table 4, it is possible to provide an NTC thermistor element which is subject to small variations in resistance value and B-value and is superior in reliability, similarly to the results shown in Table 2 even if the material composing the inner electrodes is altered.

Characteristics in a Case Where the Number of Inner Electrodes is Changed

Figure 8A:
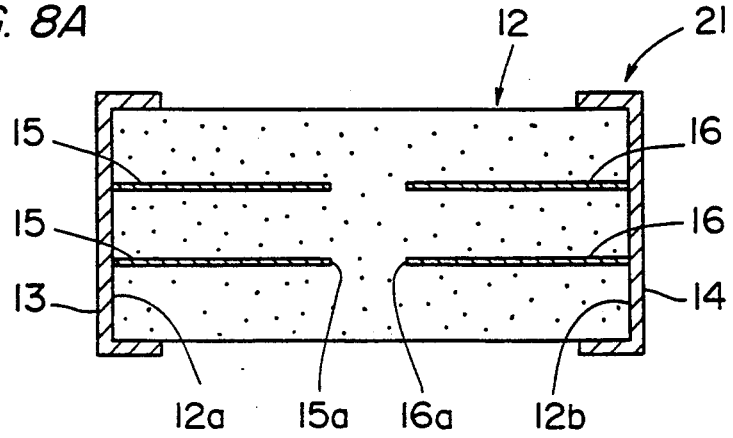
FIG. 8A is a cross sectional view showing a thermistor element in which a plurality of first and second inner electrodes are respectively formed.
Figure 8B:
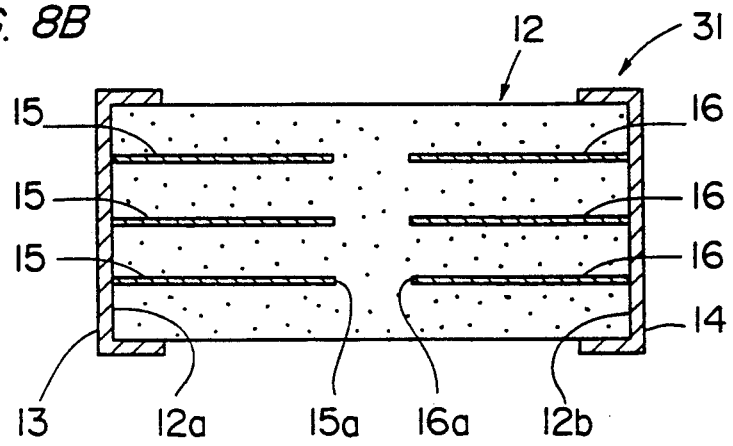
FIG. 8B is a cross sectional view showing a thermistor element in which a plurality of first and second inner electrodes are respectively formed.

As shown in FIGS. 8A and 8B, NTC thermistor elements 21 and 31 in which a plurality of first and second inner electrodes are respectively formed are fabricated using the same material as that of the NTC thermistor element shown in FIG. 1. The distance between the first and second inner electrodes is set to 0.5 mm. Measurements are made on the resistance values at a temperature of 25° C. and the variations in resistance value of the NTC thermistor element 11 according to the present embodiment shown in FIG. 1 and the respective NTC thermistor elements shown in FIGS. 8A and 8B. The results are shown in Table 5.

TABLE 5

| NUMBER OF ELECTRODES | RESISTANCE R25° C. (k Ω) | RESISTANCE R3CV (%) |
|---|---|---|
| 1 | 4.215 | 5.1 |
| 2 | 3.864 | 5.4 |
| 3 | 3.402 | 4.9 |

As can be seen from Table 5, even if a plurality of inner electrodes are formed in the direction of thickness, the variation in resistance value is very small.

Other Modified Examples

Figure 9:
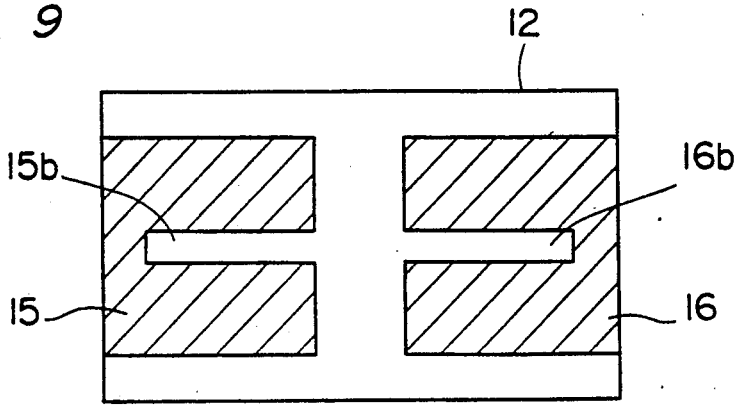
FIG. 9 is a schematic plan view showing a modified example of the first and second inner electrodes.
Figure 10:
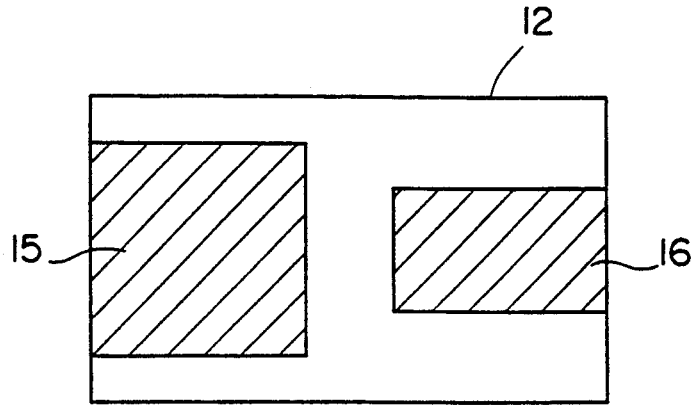
FIG. 10 is a schematic plan view showing another modified example of the first and second inner electrodes.

As shown in FIG. 4, the first and second inner electrodes 15 and 16 are formed in the same rectangular shape. As shown in FIG. 9, however, the first and second inner electrodes 15 and 16 may be respectively formed in a shape other than the rectangular shape by forming concave portions 15*b* and 16*b*. In addition, as shown in FIG. 10, the widths of the first and second inner electrodes 15 and 16 may be made different from each other. Further, the lengths of the first and second inner electrodes 15 and 16 may be made different from each other.

Figure 11:
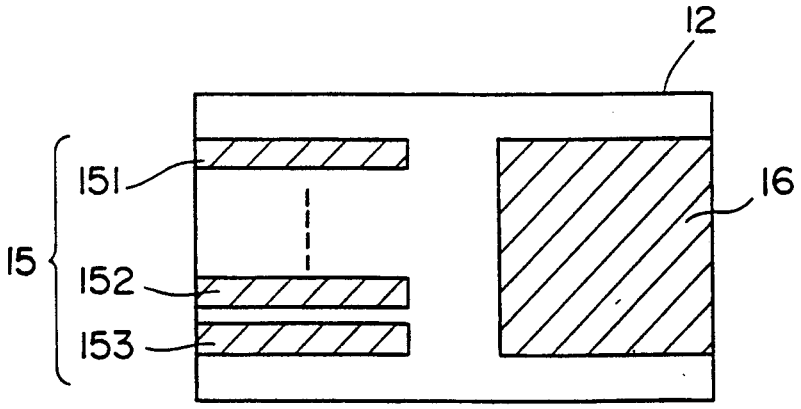
FIG. 11 is a schematic plan view showing an example in which a first inner electrode is divided into a plurality of electrode parts.

Furthermore, as shown in FIG. 11, one of the inner electrodes 15 may be divided into a plurality of electrode parts 151 to 153.

Figure 12:
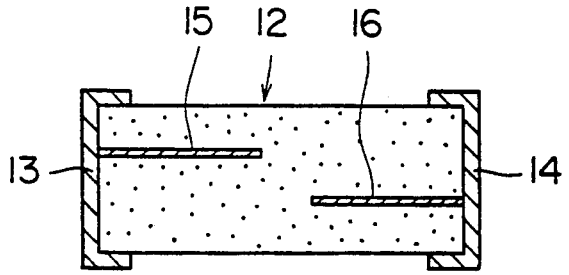
FIG. 12 is a cross sectional view showing an example in which first and second inner electrodes are formed on different planes.

Additionally, as shown in FIG. 12, the first and second inner electrodes 15 and 16 may be formed on different planes.

Although description was made of an NTC thermistor element by way of example, the present invention can be also applied to a PTC thermistor element.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thermistor element comprising:

a thermistor body;

first and second outer electrodes formed on opposed outer surfaces of said thermistor body; and first and second inner electrodes, having first ends respectively connected to said first and second outer electrodes, said first and second inner electrodes extending into said thermistor body so that respective second ends of said inner electrodes are opposed a predetermined distance away from each other without overlapping.

2. The thermistor element according to claim 1, wherein remaining said first ends other than edges respectively connected to the first and second outer electrode, of said first and second inner electrodes are disposed in the thermistor body.

3. The thermistor element according to claim 1, wherein said thermistor body is constructed using a ceramic sintered body obtained by laminating a plurality of ceramic green sheets, along with first and second inner electrode materials, followed by cofiring.

4. The thermistor element according to claim 1, wherein a plurality of the first and second inner electrodes are respectively formed in the thermistor body.

5. The thermistor element according to claim 1, wherein the thermistor element is an NTC thermistor element.

6. The thermistor element according to claim 1, wherein the thermistor element is a PTC thermistor element.

7. A thermistor element comprising:

a thermistor body;

first and second outer electrodes formed on opposed outer surfaces of said thermistor body; and first and second inner electrodes respectively connected to said first and second outer electrodes and extending into said thermistor body, said first and second inner electrodes being so formed that respective ends of said inner electrodes are opposed a predetermined distance away from each other, wherein said first and second inner electrodes are formed on the same plane in the thermistor body.

8. The thermistor element according to claim 7, wherein remaining edges, other than edges respectively connected to the first and second outer electrode, of said first and second inner electrodes are disposed in the thermistor body.

9. The thermistor element according to claim 5, wherein said thermistor body is constructed using a ceramic sintered body obtained by laminating a plurality of ceramic green sheets, along with first and second inner electrode materials, followed by cofiring.

10. The thermistor element according to claim 5, wherein a plurality of the first and second inner electrodes are respectively formed in the thermistor body.

11. The thermistor element according to claim 5, wherein the thermistor element is a NTC thermistor element.

12. The thermistor element according to claim 5, wherein the thermistor element is a PTC thermistor element.

13. A thermistor element comprising:

a thermistor body;

first and second outer electrodes formed on opposed outer surfaces of said thermistor body; and first and second inner electrodes, having first ends respectively connected to said first and second outer electrodes, said first and second inner electrodes extending into said thermistor body so that respective second ends of said inner electrodes are opposed a predetermined distance away from each other without overlapping, and said first and second inner electrodes are formed on different planes in the thermistor body.

14. The thermistor element according to claim 6, wherein said first and second inner electrodes, other than said first ends respectively connected to the first and second outer electrode, are disposed in the thermistor body.

15. The thermistor element according to claim 6, wherein said thermistor body is constructed using a ceramic sintered body obtained by laminating a plurality of ceramic green sheets, along with first and second inner electrode materials, followed by cofiring.

16. The thermistor element according to claim 6, wherein a plurality of the first and second inner electrodes are respectively formed in the thermistor body.

17. The thermistor element according to claim 6, wherein the thermistor element is a NTC thermistor element.

18. The thermistor element according to claim 6, wherein the thermistor element is a PTC thermistor element.

* * * * *

UNITED STATES PATENT AND TRADEMARK OFFICE

CERTIFICATE OF CORRECTION

PATENT NO. : 5,245,309

DATED : September 14, 1993

INVENTOR(S) : Masahiko KAWASE et al.

It is certified that error appears in the above-identified patent and that said Letters Patent is hereby corrected as shown below:

IN THE CLAIMS:

Column 10, line 15, change "5" to --7--;

line 20, change "5" to --7--;

line 23, change "5" to --7--;

line 26, change "5" to --7--;

line 42, change "6" to --13--;

line 47, change "6" to --13--;

line 52, change "6" to --13--;

line 55, change "6" to --13--;

UNITED STATES PATENT AND TRADEMARK OFFICE

CERTIFICATE OF CORRECTION

PATENT NO. : 5,245,309

DATED : September 14, 1993

INVENTOR(S) : Masahiko KAWASE et al.

It is certified that error appears in the above-identified patent and that said Letters Patent is hereby corrected as shown below:

Column 10, line 58, change "6" to --13--.

Signed and Sealed this

Tenth Day of August, 1999

*Attest:*

*Attesting Officer*

Q. TODD DICKINSON

*Acting Commissioner of Patents and Trademarks*